United States Patent [19]

Wells et al.

[11] Patent Number: 4,713,901

[45] Date of Patent: Dec. 22, 1987

[54] SYSTEM FOR RETAINING AND DISPLAYING BUSINESS CARDS

[75] Inventors: Virginia J. Wells; Gerald B. Klein, both of Broomfield, Colo.

[73] Assignee: Gerald B. Klein, Broomfield, Colo.

[21] Appl. No.: 825,385

[22] Filed: Feb. 3, 1986

[51] Int. Cl.[4] ..... B42F 19/04

[52] U.S. Cl. ..... 40/360; 40/377; 40/404

[58] Field of Search ..... 402/79; 283/61, 36; 40/360, 594, 388, 390, 391, 377, 395, 404; D19/1; D20/40

[56] References Cited

U.S. PATENT DOCUMENTS 3,930,700 1/1976 Figueres ..... 402/79

3,970,397 7/1976 Armstrong ..... 40/360

FOREIGN PATENT DOCUMENTS 315778 10/1956 Switzerland ..... 40/395

*Primary Examiner*—Gene Mancene

*Assistant Examiner*—Cary E. Stone

*Attorney, Agent, or Firm*—Dennis O. Kraft

[57] ABSTRACT

A file-index card system for retaining and displaying conventional business cards is disclosed. The system includes a frame in which is held a multiplicity of file cards in the form of planar sheets. Each file card has an area of adhesive covering a portion thereof, with a protective peel-off covering placed over the area of adhesive. Registration markings are provided on each file card to at least one side of the area of adhesive, the registration markings serving to delimit the edge of a conventional business card to be affixed to the file card. In use, the protective peel-off covering is removed to expose the adhesive. A conventional business card is then aligned with the registration markings and is affixed to the file card to thereby be displayed.

5 Claims, 6 Drawing Figures

SYSTEM FOR RETAINING AND DISPLAYING BUSINESS CARDS

BACKGROUND OF THE INVENTION

This invention broadly relates to information storage devices and is particularly concerned with the provision of an apparatus for retaining and displaying business or calling cards.

Many file card systems are available for use in storing, indexing, and retrieving information such as names, addresses, telephone numbers and the like. Typically, the user of such file card systems is required to remove a particular file or index card, and either print or type information upon same, the file or index card thereafter being reinserted into its holder or frame therefor. These conventional file card systems do not readily accommodate persons who may receive business or calling cards and the like (all such cards being generically referred to hereinafter as "business cards"), which persons may desire to not only file the information on such business cards, but to retain the business cards per sé. Such a person is required to remove a conventional file or index card from its frame or holder and print or type thereon the information obtained from a business card, with the business cards being thereafter stored in a haphazard fashion.

In the typical business setting, the transfer of information from a business card to a file or index card therefore requires a significant amount of effort, so much so that same is oftentimes overlooked. Further, the retention and storage of business cards is quite unorganized and such business cards are readily misplaced as a result.

BRIEF SUMMARY OF THE INVENTION

A need clearly exists for a mechanism or system which eliminates the typical problem of haphazard storage of business cards and, at the same time, assures that the information on such business cards is readily and effectively available for storage and retrieval. It is the primary objective of the instant invention to provide an apparatus which satisfies this need, an apparatus which serves to readily and efficiently retain and display business cards.

A further objective of the instant invention concerns the provision of an apparatus which can markedly reduce the work effort involved in transferring pertinent information from a business card onto a file or index card.

Yet another objective of the instant invention is the provision of an apparatus which allows a business card to be directly affixed to a file or index card, thus eliminating the opportunity for a typist or secretary to make an error in transcribing information from the business card to the file or index card.

These as well as other objectives are implemented by the instant invention which, as aforementioned, is directed to the provision of an apparatus which serves to retain and display business cards. The apparatus comprises a frame means which is capable of holding a multiplicity of planar sheets, such as file or index cards. An area of adhesive is disposed on and covers a portion of a surface of each planar sheet.

A throw-away, protective peel-off covering is disposed over the area of adhesive. Registration means, constituting printed indicia or markings, for example, are provided on each sheet to at least one side of the area of adhesive, the registration means delimiting the edge of a business card to be affixed to the planar sheet in justaposition over the area of adhesive upon removal of the peel-off covering.

Lastly, means are provided for removably attaching the planar sheet to the frame means such that the sheet and the business card affixed thereon may be retained and displayed.

BRIEF DESCRIPTION OF THE DRAWINGS

The invention itself will be better understood, and further features and advantages thereof will become apparent from the following detailed description of a preferred inventive embodiment, such description making reference to the appended single sheet of drawings wherein.

DETAILED DESCRIPTION OF THE INVENTION

Figure 1:
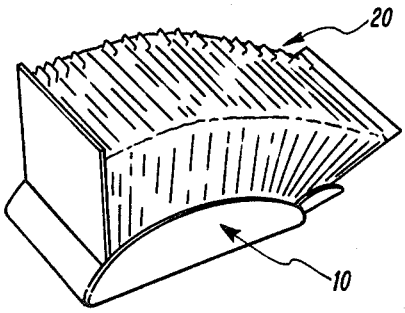
FIG. 1 is a perspective illustration of a file or index card displaying apparatus constructed in the form of a tray or box.

With reference now to the drawings, and particularly to FIG. 1 thereof, one form of an apparatus is disclosed suitable for use in retaining and displaying business cards. The apparatus will be seen to comprise a frame means or card holder generally designated by reference numeral 10 adapted to receive and hold a multiplicity of planar sheets generally designated by reference numeral 20 which comprise file or index cards constructed in the manner depicted in FIGS. 3 through 5, for example.

Figure 2:
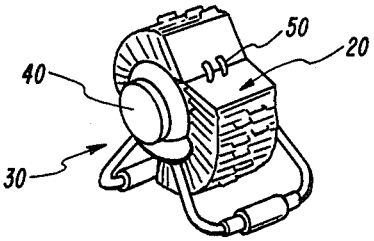
FIG. 2 is a perspective illustration of a file or index card displaying apparatus constructed in the form of a rotary "flip-file"

An alternative construction of a frame means is that depicted in FIG. 2 of the appended drawings, wherein the frame means 30 therein is constructed as a rotary "flip-file" containing a central wheel 40 having rods or channels 50 disposed thereon so as to hold the multiplicity of file or index cards 20 therein. As the rotary wheel 40 is turned, the multiplicity of file or index cards "flip" and the information upon each card is readily visible to the user. Frame means such as is shown in FIGS. 1 and 2 are generally known to the public and can be obtained from most office supply sources.

Figure 3:
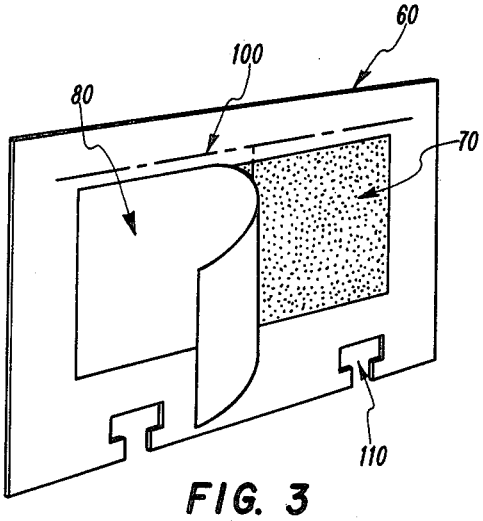
FIG. 3 is a perspective illustration of a file or index card containing an area of adhesive thereon, which illustration further depicts a protective peel-off covering disposed over the area of adhesive.

With reference now to FIG. 3 of the application drawings, a typical planar sheet 60 constituting a file or index card is shown, the card being constructed of relatively stiff paper material. Disposed on and covering a portion of a surface of the planar sheet or card 60 is at least one area of adhesive 70. The adhesive, in the preferred inventive embodiment, is contemplated to comprise a contact pressure sensitive adhesive and may, for example, be affixed to the surface of the sheet or card 60 by a conventional printing process. The adhesive will be seen to cover an area that preferably is no larger than the surface area of a business card to be affixed thereto as will be described hereinbelow.

Figure 6:
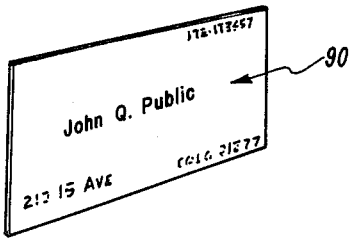
FIG. 6 is a pictorial illustration of a typical business card which is to be affixed to the file or index card in juxtaposition over the area of adhesive.

Disposed over the area of adhesive 70 on each planar sheet 60 is a protective peel-off covering 80 composed of a material, such as a waxed paper or plastic, which will not permanently adhere to the adhesive. The peel-off covering is contemplated to be removed and thrown away just prior to the placement of a business card, such as indicated at reference numeral 90 in FIG. 6, for example, over the area of adhesive 70 on the planar sheet 60.

Registration means such as is generally indicated by reference numeral 100 is provided on each sheet or card 60 to at least one side of the area of adhesive, the registration means serving to delimit the edge of the business card 90 to be affixed to the planar sheet in juxtaposition over the area of adhesive 70 upon removal of the peel-off covering 80. The registration means can, for example, comprise markings as illustrated, actually printed onto the surface of the sheet. Alternatively, the registration means could constitute embossed areas, or even perforations.

Lastly, means such as generally indicated by reference numeral 110 are provided for removably attaching the planar sheet or card 60 to the frame means 10 or 30 as in FIGS. 1 and 2. Means 110 can, for example, constitute at least one tab provided on each sheet 60, with the tab being disposed within the customary channel members or rods 50 of the frame means.

Figure 4:
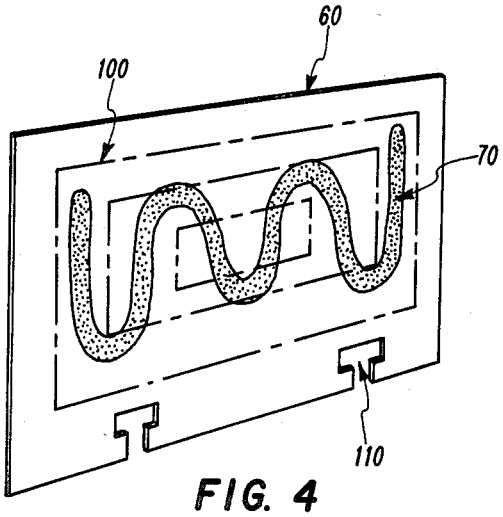
FIG. 4 is an illustration of a file or index card depicting an alternative placement of the area of adhesive.

With reference to FIG. 4 of the application drawings, the area of adhesive 70 is seen to be disposed in a serpentine pattern. This serpentine deposition area requires far less adhesive material than the area 70 depicted in FIG. 3, for example, and thus is more economical to manufacture. Yet, this serpentine pattern will still adequately retain a business card 90 disposed thereon.

Figure 5:
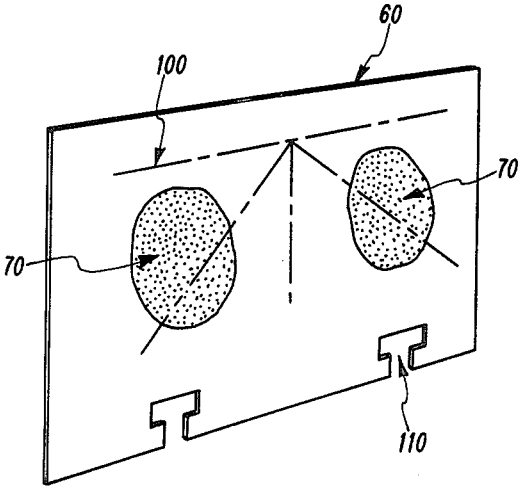
FIG. 5 is another perspective illustration depicting a further alternative disposition of the area of adhesive on a file or index card in accordance with the teachings of the instant invention.

A further variant of the instant invention is depicted in FIG. 5 of the application drawings, wherein two circular areas of adhesive 70 are provided on the surface of the planar sheet or index card 60. Two business cards 90 could be affixed to such planar sheet 60, one over each of the two circular areas of adhesive.

Obviously, other patterns of adhesive deposition could be utilized consistently with the principles of the instant invention. Additionally, the invention contemplates in yet another non-illustrated embodiment thereof the application of adhesive to both sides of the planar sheet or card 60, thus enabling each sheet or card to hold business cards on each side.

In use, and when a business card is desired to be retained and filed, the peel-off covering 80 would be removed from the underlying adhesive 70 on a new planar sheet or index card 60 and disposed of. The business card would then be affixed in juxtaposition over the underlying area of adhesive and would be pressed onto the adhesive, thus activating same. As a result, the business card will be firmly retained on the file or index card, which file or index card would then be placed within the frame means or holding mechanisms 10 or 20. No laborious transfer of information from the business cards to the file or index cards is required, and the busines cards are safely stored in a well-organized manner.

It should now be recognized that the objectives set forth at the outset of this specification have been successfully achieved.

What is claimed is:

1. A system for retaining and displaying conventional business cards, said system comprising:

a frame means for holding a multiplicity of file cards in the form of planar sheets;

at least one file card being disposed in said frame means;

means for removably attaching each said file card to said frame means;

adhesive means disposed on and covering a portion of a surface of each file card;

a protective peel-off covering disposed over the adhesive means, said covering being removable to expose the adhesive means; registration means provided on said file card to at least one side of the area of adhesive, said registration means delimiting the edge of a conventional business card to be affixed to the file card; and a conventional business card affixed to at least one file card by and in juxtaposition over said exposed adhesive means such that said business card is displayed.

2. The system as defined in claim 1, wherein said means for removably attaching said planar sheet to said frame means includes at least one tab provided on said sheet and at least one channel member provided on said frame means, said tab being disposed within said channel member.

3. The system as defined in claim 2, wherein said adhesive comprises a contact pressure sensitive adhesive.

4. The system as defined in claim 3, wherein said registration means comprises markings printed on the surface of said planar sheet.

5. A method of retaining and displaying conventional business cards in a file index card system including a frame in which a multiplicity of planar file cards is removably attached, with each file card having an area of adhesive thereon, a registration means to at least one side of the area of adhesive, and a peel-off covering over the area of adhesive, said method comprising the steps of:

removing the peel-off covering to expose the area of adhesive on the file card; and placing the conventional business card in juxtaposition over the area of adhesive on the file card with an edge of the business card being aligned with the registration means, so that the adhesive affixes the business card to the file card.

* * * * *